United States Patent [19]

Hoogenboom

[11] 4,454,741

[45] Jun. 19, 1984

[54] FLOW DRILL FOR THE PROVISION OF HOLES IN SHEET MATERIAL

[75] Inventor: Aloysius J. Hoogenboom, Baarsdorp, Netherlands

[73] Assignee: Flowdrill B.V., Utrecht, Netherlands

[21] Appl. No.: 350,396

[22] Filed: Feb. 19, 1982

[51] Int. Cl.[3] ..... B21D 28/36

[52] U.S. Cl. ..... 72/71; 72/325

[58] Field of Search ..... 72/69, 70, 71, 325

[56] References Cited

U.S. PATENT DOCUMENTS 3,939,683 2/1976 van Geffen ..... 72/71

*Primary Examiner*—Lowell A. Larson

*Attorney, Agent, or Firm*—Murray Schaffer

[57] ABSTRACT

A flow drill having a cross sectional contour defined by a complex harmonic curve symmetrical in the rotation direction permitting reverse of drill rotation.

2 Claims, 3 Drawing Figures

FLOW DRILL FOR THE PROVISION OF HOLES IN SHEET MATERIAL

The present invention relates to a flow drill for the production of holes having a collar, in metal sheet or metal tube walls through the intermediary of friction heat and pressure. The drill comprises a shaft and a smooth tapering operative end, the cross-section of which is based on a regular polygon and having convex contour situated within the circle circumscribing the body hole.

Such flow drills are known, e.g. from the French Pat. No. 1189384 and the Dutch Pat. No. 160499.

According to the French patent the cross-section of the operative drill end is a square, having rounded apexes. It has been found, that such a drill is suitable for the formation of holes in softer metals such as aluminum and copper or brass, but not for the formation of holes in harder metals. In hard metals such as bronze and steel this drill does not offer good results and will wear out after having made but a relatively small number of holes.

The flow drill according to the Dutch Pat. No. 160499 is based in its shape of the cross-section of the operative part on an equilateral triangle, each having apex radiuses comprising two arcs each merging in the apex and each having different radius of curvature and different length. In between the apex radiuses the contour likewise may be in the shape of an arc, but having a larger radius of curvature, or by a straight line. The apexes of the triangle are too much accentuated due to said transitions in radius of curvature, whereby instability in the operation of the drill may occur, particularly if said drill is used for flaring tube ends, resulting in the formation of a somewhat square end instead of a circular shape.

Furthermore with the known flow drill the pressure per unit of area becomes too large in the short arc, which leads to heat stresses and small fissures in the drill and thereby to a shortening of its useful life. This arises from the fact that the radiuses of the arcs have not been adapted to a mixed lubrication, i.e. partly hydrodynamic as a result of the flowing material and partially dry. Almost exclusively dry friction and thereby a strong wear of the drill occurs. On the other hand the drill is much too relieved relative to the hole wall at the position of the longer one of the two apex arcs, whereby at that point adhesion of material to the drill occurs, which material has to be removed periodically. A self cleaning action of the drill by a reverse of the direction of rotation is impossible due to the non-symmetry of the apex arcs.

Finally grinding the drill can only be carried out by means of a cam in connection with the special transverse contour which is not really continuous due to the steps in the curvature radiuses of the arcs. For each different diameter or topcone of the drill a different cam must be used.

The present invention aims at providing an improved flow drill not having the above mentioned disadvantages. This is achieved according to the invention in that the contour of the cross-section may be shown by the formula:

$$R(\phi) = R_o - \tfrac{1}{2}e + \tfrac{1}{2}e\cos\left\{\arccos\left(\delta\sin^2 n\phi + \frac{|\cos n\phi|}{\cos n\phi}\sqrt{\delta^2\sin^4 n\phi - \delta^2\sin^2 n\phi + \cos^2 n\phi}\right) + \alpha\right\}$$

in which the condition is valid for the solutions of $R(\phi)$:

$$(\sin n\phi)\cdot\sin\left\{\arccos\left(\delta\sin^2 n\phi + \frac{|\cos n\phi|}{\cos n\phi}\sqrt{\delta^2\sin^4 n\phi - \delta^2\sin^2 n\phi + \cos^2 n\phi}\right)\right\} \geqq 0,$$

and in which R = Radius vector from the drill center, $R_0$ = radius vector in a starting point of the contour in one of the apexes of the polygon, $\phi$ = the angle between R and $R_O$, $e = R^{max} - R^{min}$, $\delta$ = the modulation factor and $\alpha$ = the non-symmetry factor.

Thereby, a really continuous contour is obtained which is based on a complex harmonic curve and thereby a uniform load distribution along the part thereof entering into engagement with the hole wall. The relief relative to the hole wall in the remaining contour part is very small or absent, in which last mentioned case there always is a small contact pressure whereby growth or adhesion of material is minimized. With non-ferrous metals still some growth may occur but this may be immediately removed by reversing the direction of rotation of the drill, which is possible due to the symmetrical extension of the countour. Moreover, the wear of the drill may be made more uniform by intermittent reverse of rotation. Moreover, a mixed lubrication between the drill and the hole wall occurs due to the extension of the contour according to the invention.

If in the above mentioned formula n = 3 then the basic shape of the contour is a triangle. However, it may also be a square, pentagon or hexagon. The embodiments preferred in practice are drills based on a square since their operational stability is greater than that of drills based on a triangle, while those drills based on a pentagon or hexagon too closely approximate the circular shape. For manufacturing the drill no cams are necessary. The drill may be ground in accordance with the contour according to the formula on a numerically controlled grinding machine.

The invention will hereunder be further explained with reference to the drawing.

Figure 1:
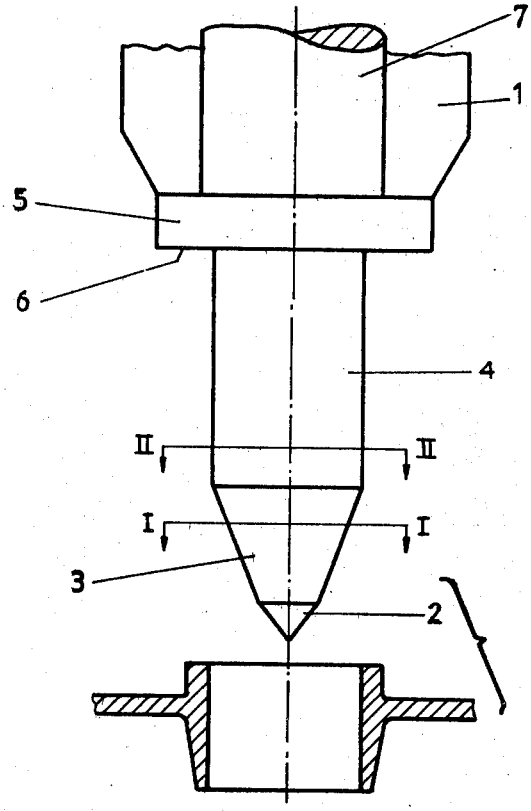
FIG. 1 shows a side view of the drill in conjunction with a hole manufactured through that drill.

The drill as shown has a first conical part 3, having a pointed centering portion 2, a prismatic second part 4, a collar 5 having a shoulder 6 and a shaft 7 by means of which the drill may be secured in a drilling machine head.

Figure 2:
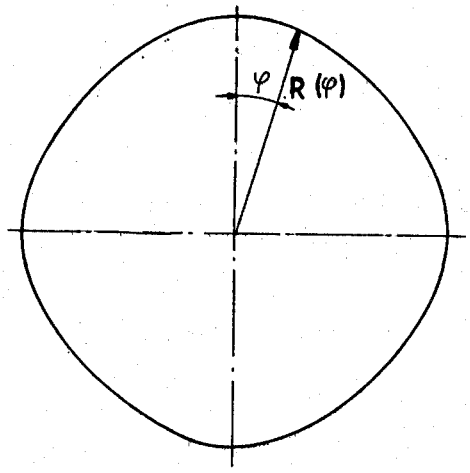
FIG. 2 is a cross-section according to I—I of FIG. 1. of a possible cross-sectional contour of the drill.
Figure 3:
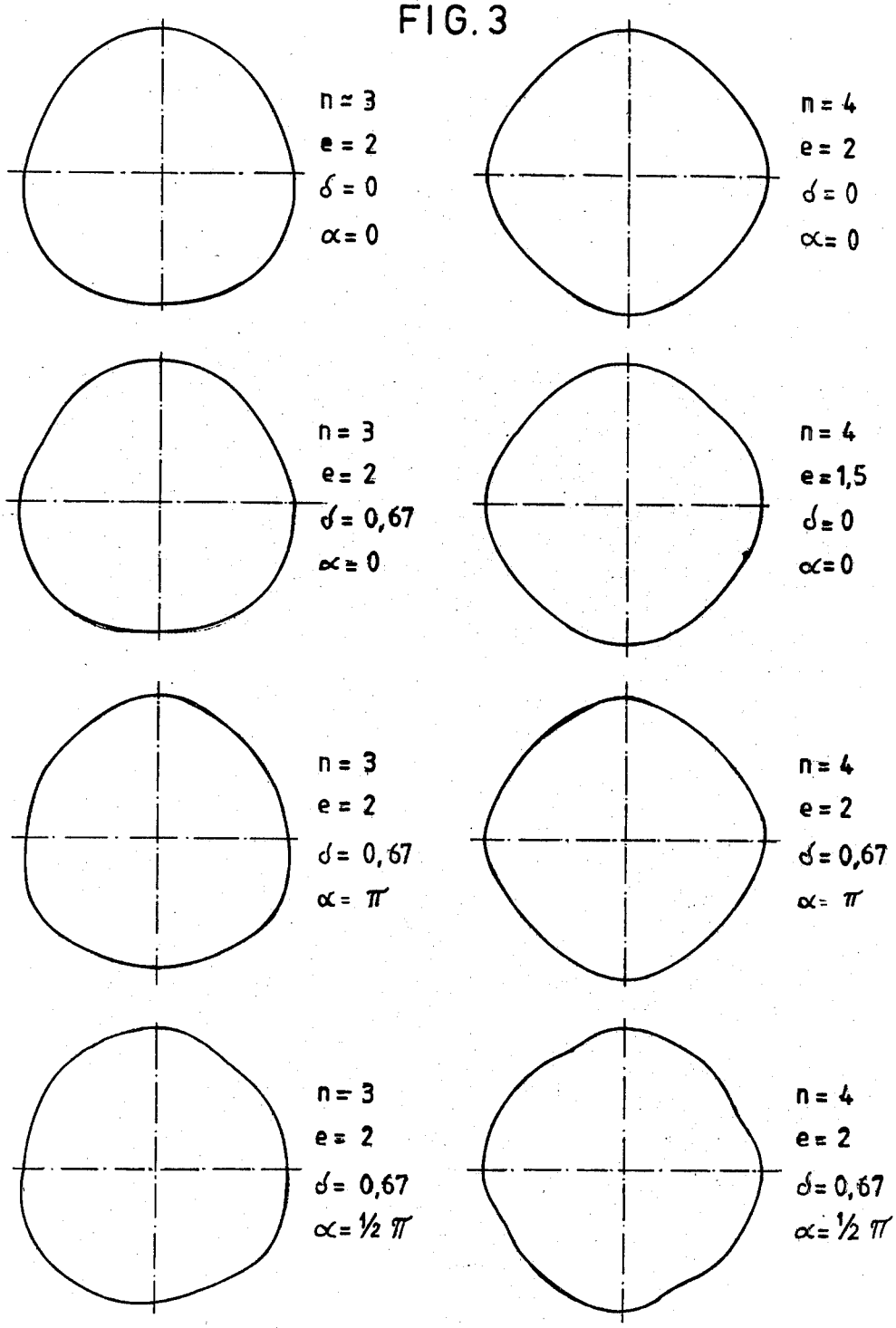
FIG. 3 shows a plurality of different possible contours, wherein for each contour the values of the parameters according to the formula are shown.

The drill according to the invention, which is suitable for making holes in copper, aluminum, bronze and steel, may be used in both rotational directions, remains free of material growth or adhesion, with a maximum in stability and life and has an operative portion 3 and 4, the cross-section of which has the contour according to the aforegiven formula, examples of which are shown in FIGS. 2 and 3.

In FIG. 3 the number of sides or apexes of the polygon on which the contour is based is indicated by n, e indicates the difference between the maximum and the minimum value of the radius vector R in the relative contour, $\delta$ indicates the so called modulation factor and determines the radius angle in the points of the curve. In practice $\delta$ is usually between 0 and 0.9. $\alpha$ is the so-called non-symmetry factor. If $\alpha$ is not equal to 0, the contour is composed of n equal parts each being non-symmetrical relative to the radius vector, situated between both end points from that contour part.

The left column of contours as shown in FIG. 3 is relative to contours based on a triangle, the right column shows contours based on a square.

From FIG. 2 of the drawing, the radius factor is always measured from the axis of the drill. This radius varies between a maximum and a minimum value. The component e as earlier indicated is $R^{max}-R^{min}$.

FIG. 3 makes apparent that the value for the non-symmetry factor $\alpha$ differing from zero causes a non-symmetry in a single modular portion of the contour. In the left part of FIG. 3 the contour has three repetitions (n=3) or three modular portions. In the right part of FIG. 3 the contour has four modular portions. In the examples indicating $\alpha=0$ each modular portion is in itself symmetrical with respect to its point situated at equal distance from the ends from said modular portion. In the four examples in the lower part of FIG. 3 this is not the case, i.e. $\alpha\neq 0$.

The modulation factor $\delta$ influences the degree of radiusing or rounding in the apexes of the curve. With n=3 there are three apexes and with n=4 there are four apexes. It appears from FIG. 3 that if $\delta\neq 0$ the apexes are more pointed than if $\delta=0$.

The non-symmetry factor and the modulation factor enable the contour of the flow drill to be adapted to specific purposes.

I claim:

1. A flow drill for the production, substantially by heat and pressure of a hole surrounded by a collar in metal sheet or metal tube walls, comprising a shaft having a smooth tapering operative end being based on a regular polygon and having a cross section defined by a continuous convex contour, situated within the circle circumscribing the polygon, and consisting of a complex harmonic curve obtained by the formula:

$$R(\phi) = R_o - \tfrac{1}{2}e + \tfrac{1}{2}e\cos\left\{\arccos\left(\delta\sin^2 n\phi + \frac{|\cos n\phi|}{\cos n\phi}\sqrt{\delta^2\sin^4 n\phi - \delta^2\sin^2 n\phi + \cos^2 n\phi)} + \alpha\right)\right\}$$

in which the condition applies to the solutions for R ($\phi$) where:

$$(\sin n\phi)\cdot\sin\left\{\arccos\left(\delta\sin^2 n\phi + \frac{|\cos n\phi|}{\cos n\phi}\sqrt{\delta^2\sin^4 n\phi - \delta^2\sin^2 n\phi + \cos^2 n\phi)}\right)\right\} >> 0,$$

in which R=the radius factor from the drill center, $R_O$=radius vector in a starting point of the contour in one of the apexes of the polygon, $\phi$=the angle between R and $R_O$, $e=R^{max}-R^{min}$, n is the number of apexes of the polygen, $\delta$ is a modulation factor and $\alpha$ is a non-symmetry factor.

2. The flow drill according to claim 1, wherein said cross section is symmetrical in the direction of rotation.

* * * * *